United States Patent [19]

Aono et al.

[11] Patent Number: 4,859,580

[45] Date of Patent: Aug. 22, 1989

[54] HEAT DEVELOPABLE PHOTOSENSITIVE MATERIAL

[75] Inventors: Toshiaki Aono; Hiroshi Hara, both of Kanagawa, Japan

[73] Assignee: Fuji Photo Film Co., Ltd., Kanagawa, Japan

[21] Appl. No.: 178,792

[22] Filed: Mar. 29, 1988

Related U.S. Application Data

[63] Continuation of Ser. No. 830,040, Feb. 18, 1986, abandoned.

[30] Foreign Application Priority Data

Feb. 18, 1985 [JP] Japan ..... 60-29905

[51] Int. Cl.[4] ..... G03C 1/40; G03C 5/54

[52] U.S. Cl. ..... 430/617; 430/203; 430/611; 430/614; 430/615; 430/351

[58] Field of Search ..... 430/617, 611, 614, 615, 430/351

[56] References Cited

U.S. PATENT DOCUMENTS

| | | | |
|---|---|---|---|
| 3,447,927 | 6/1969 | Bacon et al. | 430/617 |
| 3,801,330 | 4/1974 | Brinckman et al. | 430/617 |
| 3,832,186 | 8/1974 | Masuda et al. | 430/617 |
| 3,846,136 | 11/1974 | Sullivan | 430/617 |
| 4,499,180 | 2/1985 | Hirai et al. | 430/617 |

*Primary Examiner*—Paul R. Michl
*Assistant Examiner*—Mark R. Buscher
*Attorney, Agent, or Firm*—Sughrue, Mion, Zinn, Macpeak & Seas

[57] ABSTRACT

A heat-developable photosensitive material having, on a support, a layer comprising a binder, a light-sensitive silver halide, a reducing agent, and at least one compound selected from cyclic imino compounds or mercapto compounds, which can produce images of high quality by heat development when said light-sensitive silver halide is selected from the group consisting of silver chloride, silver bromide, silver chlorobromide, mixed crystals of silver iodide and silver chloroiodide, mixed crystals of silver iodide and silver iodobromide, and mixed crystals of silver iodide and silver chloroiodobromide.

2 Claims, No Drawings

HEAT DEVELOPABLE PHOTOSENSITIVE MATERIAL

This is a continuation of application Ser. No. 06/830,040, filed Feb. 18, 1986, abandoned.

FIELD OF THE INVENTION

This invention relates to a heat-developable photosensitive material, and more particularly to a photosensitive material which enables image formation by heat development without using an organic silver salt oxidizer therein.

BACKGROUND OF THE INVENTION

Silver halide photography is superior in photographic characteristics, e.g., photographic speed, facility of graident control, etc., to other photographic techniques such as electrophotography, diazo photography, and so on. Therefore it has so far been employed most prevailingly. In recent years, the art has developed of forming images simply and rapidly by changing the image-forming processing used in silver halide-using photography from the conventional wet process using a developing solution or the like to a dry process using a heat-applying means or the like.

Heat-developable photosensitive materials are well-known in the photographic art, and such materials and image-forming processes using them are described, e.g., in *Shashin Kogaku no Kiso,* pp. 553–555, Corona Co. (1979); *Eizo Joho,* p. 40 (April 1978); *Neblette's Handbook of Photography and Reprography,* 7th Ed., pp. 32–33, Van Nostrand Reinhold Company (1977); U.S. Pat. Nos. 3,152,904, 3,301,678, 3,392,020, and 3,457,075; British Pat. Nos. 1,131,108 and 1,167,777; and *Research Disclosure,* pp. 9–15 (RD-17029) (June 1978).

Many methods for obtaining color images through heat development have been proposed. For instance, a method of forming color images by coupling couplers to oxidation products of developers, and various kinds of developers employed therein are described in U.S. Pat. Nos. 3,531,286, 3,761,270, and 4,021,240, Belgian Pat. No. 802,519, *Research Disclosure,* pp. 31–32 (September 1975), and so on.

In addition, a method in which a nitrogen-containing heterocyclic group is introduced into a dye, converted into the corresponding silver salt, and made to release the dye by heat development is described in *Research Disclosure,* pp. 54–58 (RD-16966) (May 1978).

Moreover, a method of forming positive color images using a heat-sensitive silver dye bleach process, particularly in connection with bleaching methods of useful dyes to be employed therein, is described, e.g., in *Research Disclosure,* pp. 30–32 (RD-14433) (April 1976), ibid., pp. 14–15 (RD-15227) (December 1976), U.S. Pat. No. 4,235,957, and so on.

Further, method of forming color images utilizing leuco dyes is described, e.g., in U.S. Pat. Nos. 3,985,565 and 4,022,617, and so on.

However, these color image-forming methods have defects that silver halides, silver complex salts, developing agents and some ingredients remaining therein cause discoloration of the color images formed, coloration in the white background areas and so on upon long-range storage. Under these circumstances, improved methods for forming color images through heat development are proposed, e.g., in Japanese Patent Application (OPI) Nos. 179840/82, 186774/82, 198458/82, 207250/82, 58543/83, 79247/83, 116537/83, 149046/83, 48764/84, 65839/84, 71046/84, 87450/84, 88730/84, and so on.

Those methods consist in the production of the release of diffusible dyes in correspondence or counter-correspondence to the reduction of light-sensitive silver halides and/or organic silver salts to silver through heat development, and in the transfer of the resulting diffusible dyes into a dye-fixing element.

In such methods, light-sensitive silver halides and organic silver salt oxidizers are generally used in combination, as described above. On the other hand, as a heat-developable system in which silver halides alone are employed without combined with any organic silver salts to act as oxidizing agent, there have been known only those using silver chloroiodide, silver iodobromide, and silver chloroiodobromide, respectively, which contain iodide in such a condition as to demonstrate the X-ray diffraction pattern characteristic of silver iodide (for details of the system of the above-described type, Japanese Patent Application (OPI) No. 48764/84 should be referred to).

Conversely speaking, organic silver salt oxidizers have been considered essential for the system using such a silver chloride, silver bromide, silver chlorobromide, mixed crystals of silver iodide and silver chloroiodide, mixed crystals of silver iodide and silver iodobromide, and mixed crystals of silver iodide and silver chloroiodobromide (that is, no diffraction peak characteristic of silver iodide can be detected in the X-ray diffraction pattern thereof).

However, it is not easy to prepare such a silver halide mixture so as to have diffraction peaks characteristic of silver iodide crystal in its X-ray diffraction pattern. On the other hand, the combined use of silver halides and organic silver salts results in increased amounts of silver being used, tends to cause fog, tends to lower a signal to noise ratio, etc.

Therefore, it has formed a subject of great interest to find a way of effecting heat development without using any organic silver salt oxidizers in combination with silver halides, even when the silver halides have no diffraction peaks characteristic of silver iodide crystal in their X-ray diffraction pattern.

SUMMARY OF THE INVENTION

An object of this invention is to provide a heat-developable photosensitive material which can be developed by heating to provide an image of sufficiently high density without using any organic silver salt oxidizers.

The above-described object has now been attained with a heat-developable photosensitive material having, on a support, a layer comprising a binder, a light-sensitive silver halide selected from the group consisting of silver chloride, silver bromide, silver chlorobromide, mixed crystals of silver chloroiodide, mixed crystals of silver iodobromide, and mixed crystals of silver iodide and silver chloroiodobromide, a reducing agent, and at least one compound selected from cyclic imino compounds and mercapto compounds.

DETAILED DESCRIPTION OF THE INVENTION

The heat-developable photosensitive material of this invention contains at least one compound selected from cyclic imino compounds represented preferably by formula (I)

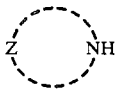

(I)

wherein Z represents nonmetallic atoms forming a heterocyclic ring containing an imino group together with the nitrogen atom, or mercapto compounds represented preferably by formula (II)

R—S—M (II)

wherein M represents a hydrogen atom or an alkali metal atom, and R represents an aliphatic hydrocarbon group, an aromatic hydrocarbon group, or a heterocyclic ring.

Of cyclic imino compounds represented by formula (I), those represented by formulae (III) through (XI) are more preferably employed in the present invention.

Formula (III)

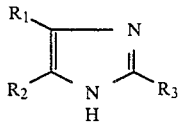

Formula (IV)

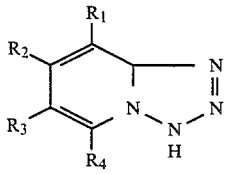

Formula (V)

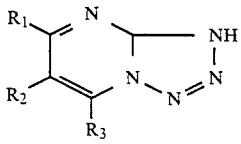

Formula (VI)

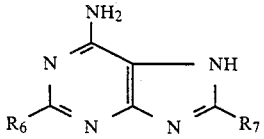

Formula (VII)

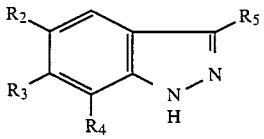

Formula (VIII)

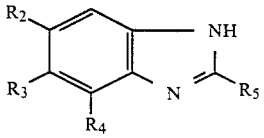

Formula (IX)

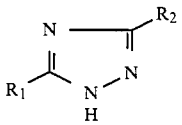

-continued

Formula (X)

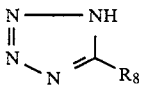

Formula (XI)

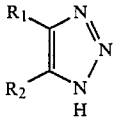

In formulae (III) to (XI), $R_1$, $R_2$, $R_3$, and $R_4$ each represents a hydrogen atom, an alkyl group, an aralkyl group, an alkenyl group, an alkoxy group, an aryl group, —NRR′, —COOR″, —CONRR′, —$NHSO_2R$, —$SO_2NRR'$, —$NO_2$, a halogen atom, —CN, or —OH (wherein R and R′ each represents a hydrogen atom, an alkyl group, an aryl group, or an aralkyl group, and R″ represents an alkyl group, an aryl group, or an aralkyl group).

When both $R_1$ and $R_2$ are alkyl groups, they may form an aliphatic carbocyclic ring by combining with each other, and in case of formula (XI), they may form an aromatic carbocyclic ring also.

$R_5$ represents a hydrogen atom, an alkyl group containing from 1 to 5 carbon atoms, or —S—R‴ (wherein R‴ represents a hydrogen atom, an alkyl group, an aryl group, or an aralkyl group).

$R_6$ represents a hydrogen atom or an alkyl group, and $R_7$ represents a hydrogen atom, an alkyl group, or an aryl group.

$R_8$ represents an alkyl group, an aryl group, a benzyl group, or a pyridyl group.

Of the mercapto compounds represented by formula (II), those represented by formula (XII) are more preferably employed.

Formula (XII)

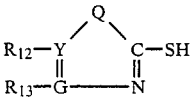

In formula (XII) illustrated above, Q represents an oxygen atom, a sulfur atom, or —NR⁗ (wherein R⁗ represents a hydrogen atom, an alkyl group, an unsaturated alkyl group, a substituted or unsubstituted aryl group, or a substituted or unsubstituted aralkyl group), Y and G each represents a carbon atom or a nitrogen atom, and $R_{12}$ and $R_{13}$ each represents a hydrogen atom, an alkyl group, an unsaturated alkyl group, a substituted or unsubstituted aryl group, a substituted or unsubstituted aralkyl group, —SR′′′′′ or —$NH_2$ (wherein R′′′′′ represents a hydrogen atom, an alkyl group, an aryl group, an aralkyl group, an alkylcarboxylic acid, or alkali-metal alkylcarboxylate group, or an alkylsulfonic acid or alkali-metal alkylsulfonate group), and when both Y and G are carbon atoms, $R_{12}$ and $R_{13}$ can also form a substituted or unsubstituted aromatic carbocyclic ring, or a substituted or unsubstituted nitrogen-containing heterocyclic ring.

Of the compounds represented by formulae (III) through (XII), those having no carboxylic acid groups or no sulfonic acid groups as substituents can most fully achieve the desired effects of this invention.

Specific examples of representatives of the compounds having formulae (III) to (XII), respectively, are illustrated below.

(1)
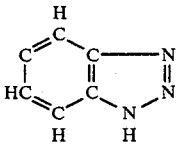
(2)
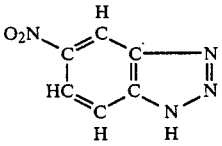
(3)
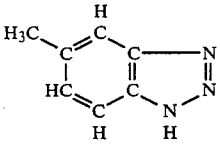
(4)
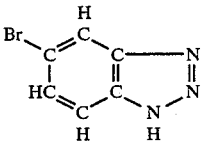
(5)
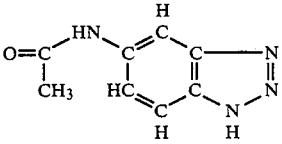
(6)
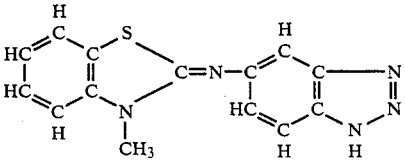
(7)
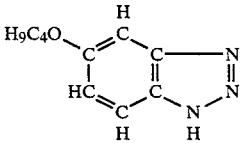
(8)
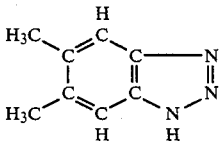
(9)
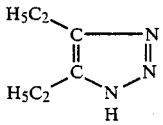
(10)
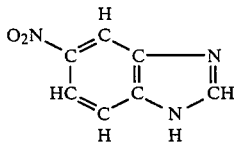
-continued
(11)
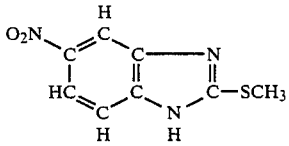
(12)
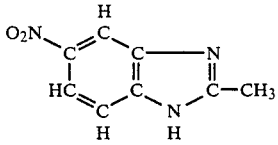
(13)
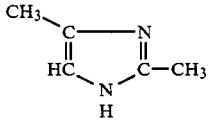
(14)
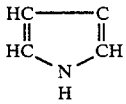
(15)
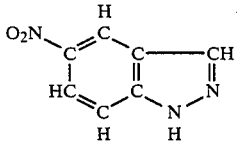
(16)
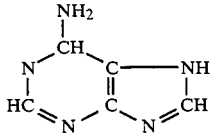
(17)
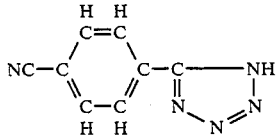
(18)
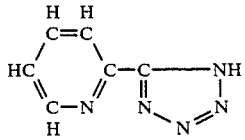
(19)
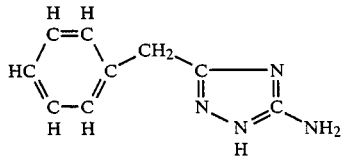
(20)
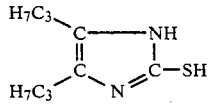
(21)
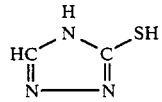

-continued
(22)
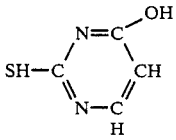
(23)
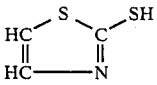
(24)
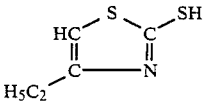
(25)
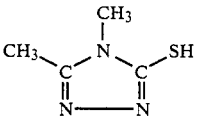
(26)
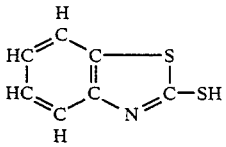
(27)
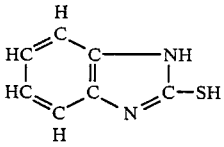
(28)
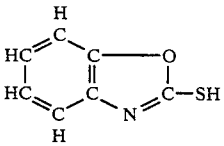
(29)
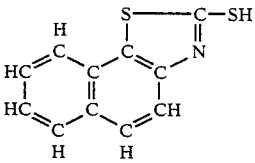
(30)
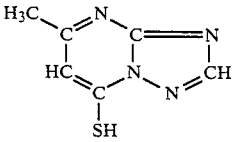
(31)
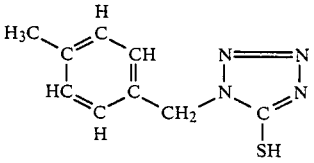
(32)
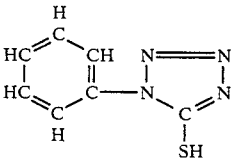
-continued
(33)
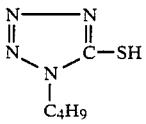
(34)
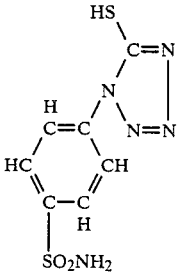
(35)
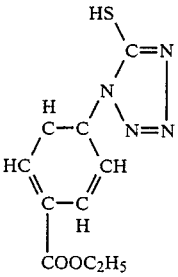
(36)
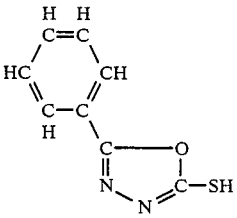
(37)
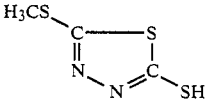
(38)
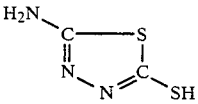
(39)
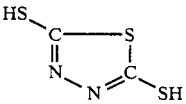
(40)
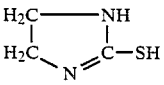
(41)
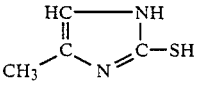
(42)
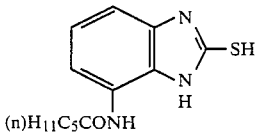

-continued

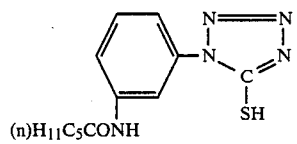

(43)

These cyclic imino compounds and mercapto compounds can fully achieve their effect when they are used in such a condition that they are adsorbed by silver halides (described below).

Such cyclic imino compounds and mercapto compounds permit heat development in this invention even if organic silver salts are not employed in combination with silver salts.

These compounds produce a good effect when used in a total content of generally from 0.001 to 100 mole%, preferably from 0.01 to 20 mole%, and particularly preferably from 0.05 to 10 mole%, per mole of silver in the light-sensitive silver halide.

Silver halides to be employed in the present invention include silver chloride, silver bromide, silver chlorobromide, mixed crystals of silver iodide and silver chloroiodide, mixed crystals of silver iodide and silver iodobromide, and mixed crystals of silver iodide and silver chloroiodobromide, and therefore have no diffraction peak characteristic of silver iodide crystal in the X-ray diffraction patterns thereof.

The halogen composition of the silver halide grains may be uniform throughout, or the interior and the surface of the silver halide grains may differ in halogen composition, that is, the silver halide grains may have a multilayer structure (described in Japanese Patent Application (OPI) Nos. 154232/82, 108533/83, 48755/84, and 52237/84, U.S. Pat. No. 4,433,048, and European Patent No. 100,984). In addition, tabular silver halide grains having a thickness of 0.5 μm or less, a diameter of at least 0.6 μm, and having a mean aspect ratio of 5/1 or more (as described in U.S. Pat. Nos. 4,414,310 and 4,435,499, German Patent Application (OLS) No. 3,241,646A1, etc.), and monodisperse emulsions having a nearly uniform distribution of grain size (as described in Japanese Patent Application (OPI) Nos. 178235/82, 100846/83, and 14829/85, International Laid-Open Patent No. 83/02338A1, European Patent Nos. 64,412A3 and 83,377A1, etc.) can be employed in this invention. Two or more silver halides which differ from one another in crystal habit, halogen composition, grain size, grain size distribution, etc., may be used in combination. Also, two or more monodisperse emulsions differing in grain size may be mixed for the purpose of gradation control.

A mean grain size of silver halide grains to be employed in the present invention ranges preferably from 0.001 to 10 μm, and more particularly from 0.001 to 5 μm.

These silver halide emulsions may be prepared using an acidic process, a neutral process or an ammoniacal process. Suitable methods for reacting a water-soluble silver salt with a water-soluble halide include, e.g., a single jet method, a double jet method, or a combination thereof. A so-called reverse mixing method, in which silver halide grains are produced in the presence of excess silver ion, or a so-called controlled double jet method, in which the pAg of the liquid phase in which silver halide grains are to be precipitated is maintained constant, may also be employed. In addition, concentrations of silver salts and halides in the reaction solution, amounts of silver salts and halides to be added or addition speeds thereof may be increased for the purpose of accelerating the grain growth (as described in Japanese Patent Application (OPI) Nos. 142329/80 and 158124/80, U.S. Pat. No. 3,650,757, and so on).

Also, silver halide grains of the epitaxial junction type can be employed in the present invention (as described in Japanese Patent Application (OPI) No. 16124/81 and U.S. Pat. No. 4,094,684).

At the stage of producing silver halide grains to be employed in the present invention, ammonia, organic thioether derivatives described in Japanese Patent Publication No. 11386/72, sulfur-containing compounds described in Japanese Patent Application (OPI) No. 144319/78, or the like can be employed as silver halide solvent.

In a process for producing silver halide grains or allowing the produced silver halide grains to ripen physically, cadmium salts, zinc salts, lead salts, thallium salts, and the like may be present.

Further, water-soluble iridium salts such as iridium(III, IV) chloride, ammonium hexachloroiridate, etc., or water-soluble rhodium salts such as rhodium chloride, etc., can be used for the purpose of improvements in high intensity reciprocity law failure and low intensity reciprocity law failure.

Soluble salts may be removed from the silver halide emulsion after the formation of the silver halide or the physical ripening thereof. The removal can be effected using the noodle washing method or the flocculation method.

The silver halide emulsion of this invention can be a primitive emulsion, that is, a chemically unsensitized emulsion. However, it is usual and preferred for the emulsion of this invention to also be chemically sensitized. Sulfur sensitization, reduction sensitization, noble metal sensitization, and like sensitization processes, which have been employed for light-sensitive silver halide emulsions of conventional type, can be used alone or in combination of two or more thereof. These chemical sensitizations can also be carried out in the presence of a nitrogen-containing heterocyclic compound (as described in Japanese Patent Application (OPI) Nos. 126526/83 and 215644/83).

The silver halide emulsion to be employed in this invention may be an emulsion of the kind which forms latent image predominantly at the face of the grains, or an emulsion of the kind which forms latent image mainly inside the grains. A direct reversal emulsion prepared by using an emulsion of the kind which forms latent image mainly inside the grains and a nucleating agent in combination can also be employed in this invention. Emulsions of the above-described kind which fit for preparation of direct reversal emulsions are described in U.S. Pat. Nos. 2,592,250 and 3,761,276, Japanese patent publication No. 3534/83, Japanese patent application (OPI) No. 136641/82, and so on. Nucleating agents suitable for the combination with the above-described emulsions are described in U.S. Pat. Nos. 3,227,552, 4,245,037, 4,255,511, 4,266,031, and 4,276,364, German patent application (OLS) No. 2,635,316, and so on.

A preferred coverage of light-sensitive silver halide in this invention ranges from 1 mg/m$^2$ to 10 g/m$^2$ based on the silver.

The silver halide to be employed in this invention may be spectrally sensitized using methine dyes or other dyes. Details of such spectral sensitizing dyes are described in Japanese patent application No. 213978/84, pp. 34–38.

The heat developable photosensitive material of this invention contains a reducing agent. Such a reducing agent includes not only known reducing agents but also dye-providing compounds having reducing power (which are described in detail hereinafter). In addition, precursors of reducing agents, which can develop reducibility under action of nucleophilic agents or heat in the developing process though they themselves do not exhibit any reducing power, are included therein.

Suitable examples of reducing agents which can be used in this invention include inorganic agents, such as sodium sulfite, sodium hydrogen sulfite, or the like, organic agents, such as benzenesulfinic acids, hydroxylamines, hydrazines, hydrizides, borane-amine complexes, hydroquinones, aminophenols, catechols, p-phenylenediamines, 3-pyrazolidinones, hydroxytetronic acids, ascorbic acid, 4-amino-5-pyrazolones, etc., and those described in T. H. James, *The Theory of the Photographic Process,* 4th Ed., pp. 291–334, Macmillan Publishing Co. (1977). In addition, precursors of reducing agents as described in Japanese patent application (OPI) Nos. 138736/81 and 40245/82, U.S. Pat. No. 4,330,617, and so on can also be utilized.

Combinations of various kinds of developers, such as those disclosed in U.S. Pat. No. 3,039,869, can also be employed.

A suitable amount of a reducing agent to be added in this invention is generally from 0.01 to 20 moles, and particularly preferably from 0.1 to 10 moles, per mole of silver.

It is to be desired in this invention that the photosensitive material should contain a dye-providing substance or such a compound as to produce or release a mobile dye, that is, a diffusible dye in correspondence or counter-correspondence to the reaction of reducing light-sensitive silver halide to silver under a high temperature condition.

Such dye-providing substances are described below more specifically.

Couplers capable of reacting with developing agents can be taken as the first instance of dye-providing substances usable in this invention. The method of utilizing these couplers consists in the formation of dyes through reaction of couplers with oxidants of developing agents which are produced by the redox reaction of silver salts with developing agents. Descriptions of this method can be found in many literatures. Specific examples of developing agents and couplers usable therein are described in detail, for example, in T. H. James, *The Theory of the Photographic Process,* 4th Ed., pp. 291–334, and pp. 354–361, Macmillan Publishing Co. (1977); Shin-ichi Kikuchi, *Shashin Kagaku* (Photographic Chemistry), 4th Ed., pp. 284–295, Kyoritsu Shuppan, Tokyo, and so on.

Azo dyes which can be employed in a heat-developable silver dye bleach process can be cited as another useful type of dye-providing substances. Specific examples of azo dyes and silver bleach processes are described in U.S. Pat. No. 4,235,957, *Research Disclosure,* pp. 30–32 (RD-14433) (April 1976), and so on.

Further, leuco dyes described in U.S. Pat. Nos. 3,985,565 and 4,022,617, and so on can be cited as still another example of dye-providing substance.

Furthermore, compounds having a function of releasing a diffusible dye in an imagewise distribution or as to diffuse imagewise, which can be utilized in the method described, for example, in European Pat. No. 76,992, can be cited as a further example of dye-providing substances.

Compounds having the above-described function can be represented by formula (LI):

$$(\text{Dye}—\text{X})_n—\text{Y} \qquad \text{(LI)}$$

Herein, Dye represents a dye moiety or its precursor moiety, X represents a chemical bond or a divalent linking group, Y represents a substrate having such a function as to change the diffusibility of the compound represented by formula $(\text{Dye}—\text{X})_n\text{Y}$ in correspondence or counter-correspondence to light-sensitive silver salts having latent image in imagewise distribution, or a substrate having a property of releasing Dye, to bring about a difference in diffusibility between Dye released and $(\text{Dye-X})_n\text{Y}$, and n represents 1 or 2. When n is 2, two (Dye-X)'s may be the same or different.

As one specific example of dye-providing substances represented by formula (LI), mention may be made of dye developers described in U.S. Pat. Nos. 3,134,764, 3,362,819, 3,597,200, 3,544,545, and 3,482,972, and so on, in which a hydroquinone type developer and a dye moiety are linked. Other specific examples include substances described in Japanese patent application (OPI) No. 63618/76, and so on, which release diffusible dyes by an intramolecular nucleophilic substitution reaction, and substances described in Japanese patent application (OPI) No. 111628/74, which release diffusible dyes when the iso-oxazolone ring contained therein changes its manner of winding inside the molecule. In the methods of utilizing the above-described dye-providing substances, respectively, such dye-providing substances release dyes or have diffusibility in the undeveloped areas, whereas in the developed areas they neither release dyes nor diffuse.

Moreover, the release or diffusion of dyes takes place in parallel with development in those methods. Therefore, it is very difficult for those methods to provide images having a high signal to noise (S/N) ratio. Accordingly, a new method has been conceived for the purpose of overcoming this defect. The method comprises incorporating previously a dye-releasing compound in its oxidant form, which does not have a dye-releasing ability, together with a reducing agent (including a precursor thereof) and reducing the oxidant by the reducing agent which remains unoxidized upon development to result in release of the diffusible dye from the dye-releasing compound. Specific examples of dye-providing substances which can be employed in the above-described method are described in Japanese patent application (OPI) Nos. 110827/78, 130927/79, 164342/81 and 35533/78.

On the other hand, as for the substances of the kind which enable the release of diffusible dyes in the developed areas, those which enable the release of a diffusible dye through the reaction of a coupler containing a diffusible dye moiety as an eliminable group with an oxidation product of a developer are described in British Pat. No. 1,330,524, Japanese patent publication No. 39165/73, U.S. Pat. No. 3,443,940, and so on. In addition, substances which enable the production of a diffusible dye through the reaction of a coupler containing a nondiffusible group as an eliminable group with anoxidation product of a developer are described in U.S. Pat. No. 3,227,550, and so on.

In the methods of utilizing these color developers, contamination of images with oxidative decomposition products of the developers becomes a serious problem. For the purpose of solving this problem, dye releasing compounds of the kind which themselves have reducing power and therefore, require no developer are conceived. Typical examples of such compounds are illustrated below together with their respective literatures. Definitions of substituents in the general formulae illustrated below are the same as in those set forth in the cited literature, hereby incorporated by reference.

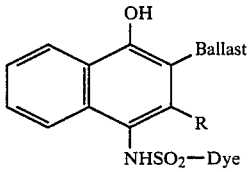

U.S. Pat. No. 3,928,312, etc.

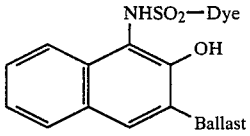

U.S. Pat. No. 4,053,312, etc.

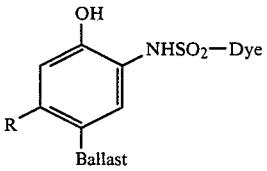

U.S. Pat. No. 4,055,428, etc.

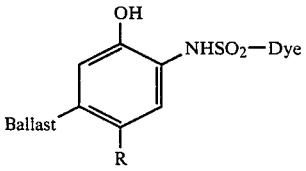

U.S. Pat. No. 4,336,322

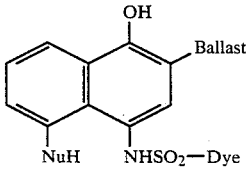

Japanese Patent Application (OPI) No. 65839/84

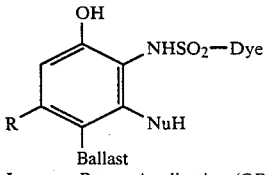

Japanese Patent Application (OPI) No. 69839/84

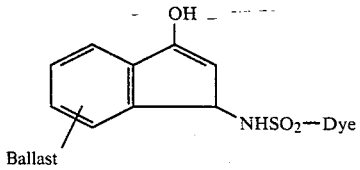

Japanese Patent Application (OPI) No. 3819/78

-continued

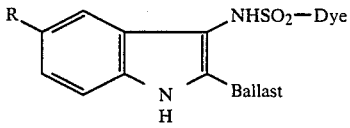

Japanese Patent Application (OPI) No. 104343/76

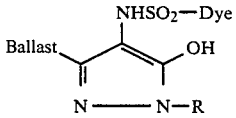

Japanese Patent Application (OPI) No. 104343/76

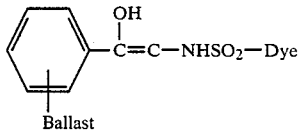

Japanese Patent Application (OPI) No. 104343/76

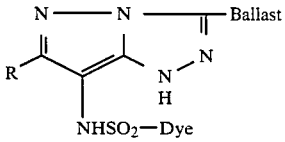

Research Disclosure, RD No. 17465, Oct. 1978

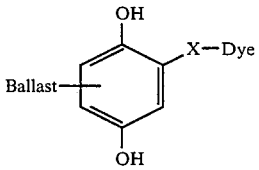

U.S. Pat. No. 3,725,062

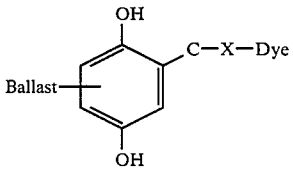

U.S. Pat. No. 3,728,113

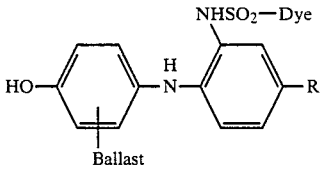

U.S. Pat. No. 3,443,939

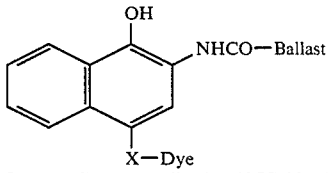

Japanese Patent Application (OPI) No. 116537/83

All of the above-described various dye-providing substances can be employed in the present invention.

Specific examples of image-forming substances which can be used in this invention are described in the literature cited above. Some typical examples of the image-forming substances which can be used to advantage are set forth below, since all suitable substances cannot be set forth herein. In particular, specific examples of dye-providing substances represented by formula (LI) are illustrated below.
LI-1
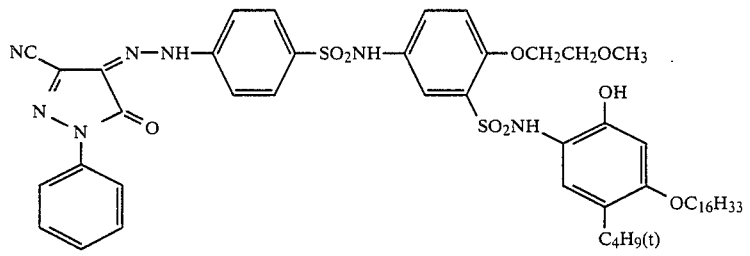
LI-2
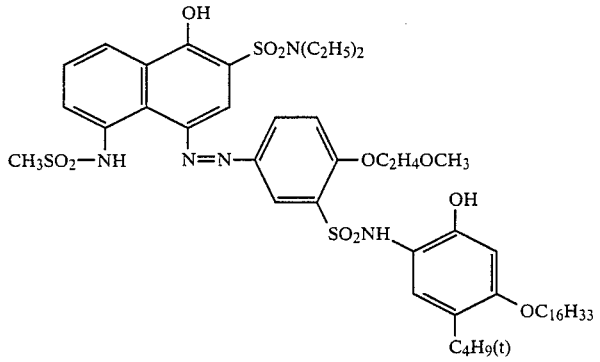
LI-3
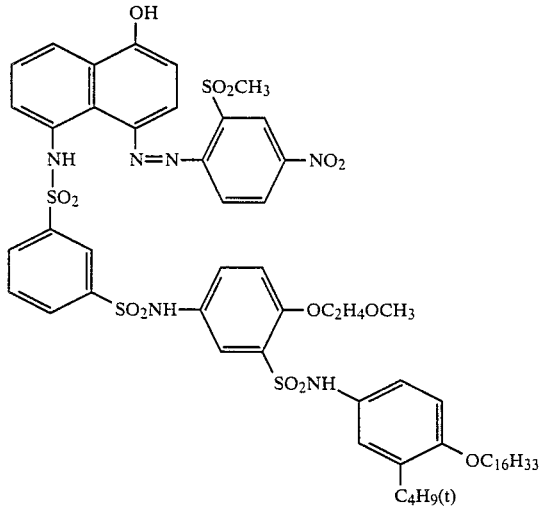
LI-4
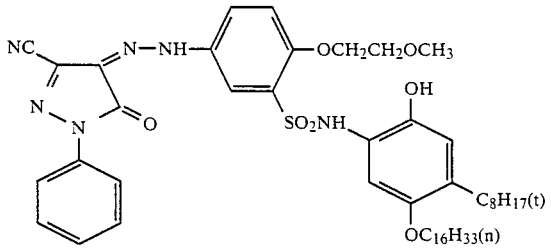

-continued
LI-5
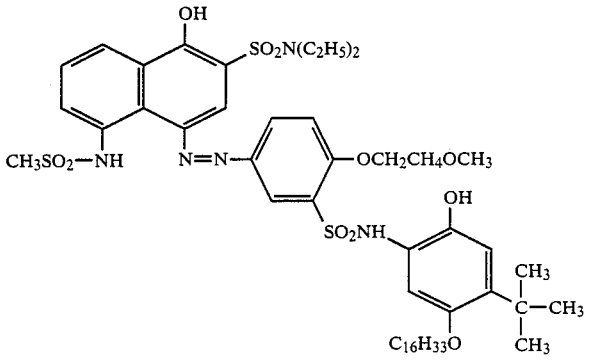
LI-6
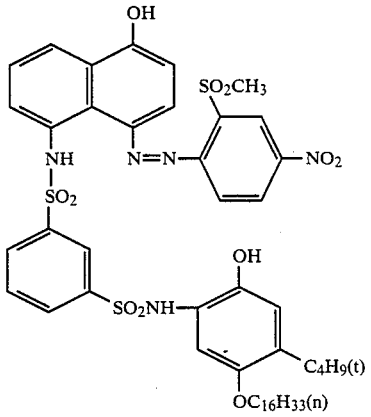
LI-7
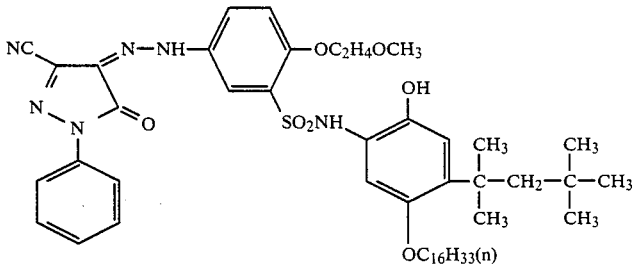
LI-8
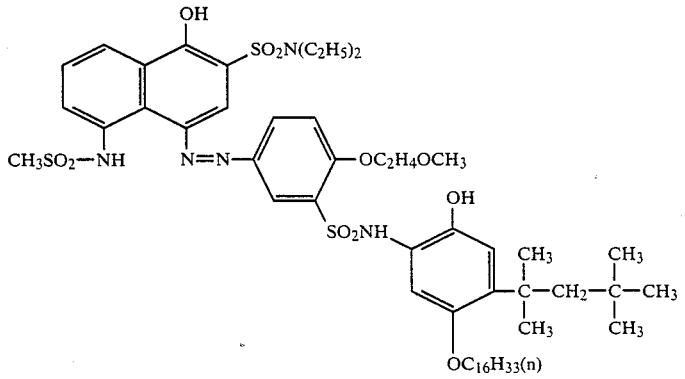

-continued
LI-9
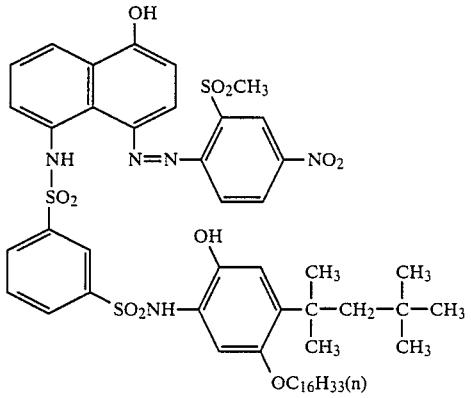
LI-10
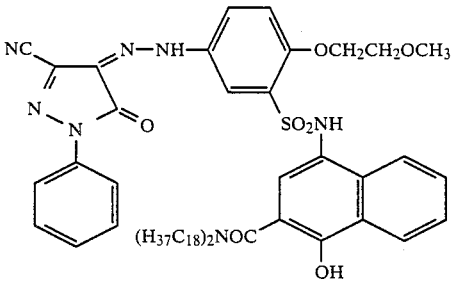
LI-11
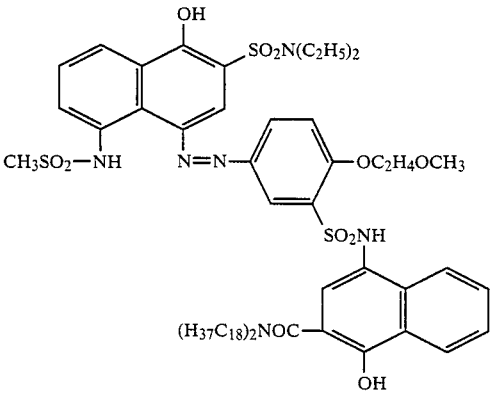
LI-12
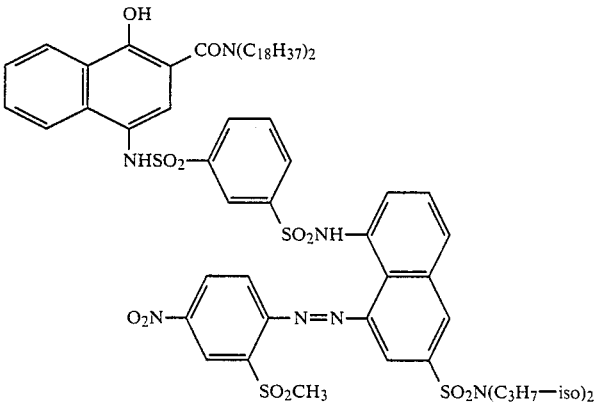

-continued
LI-13
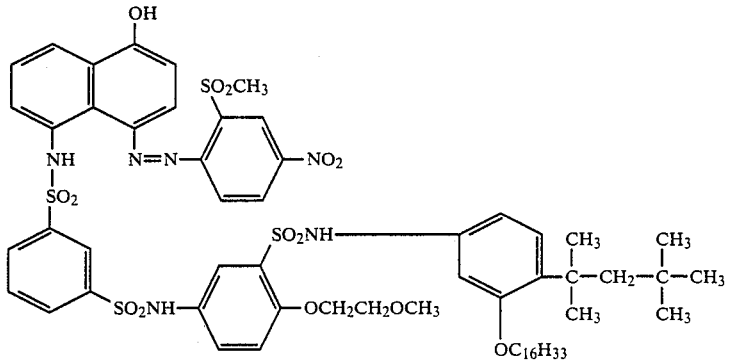
LI-14
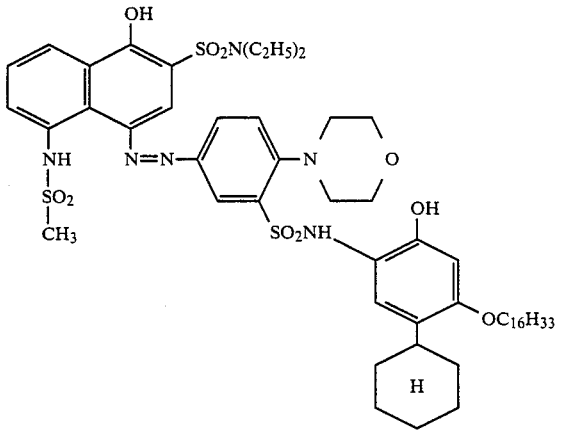
LI-15
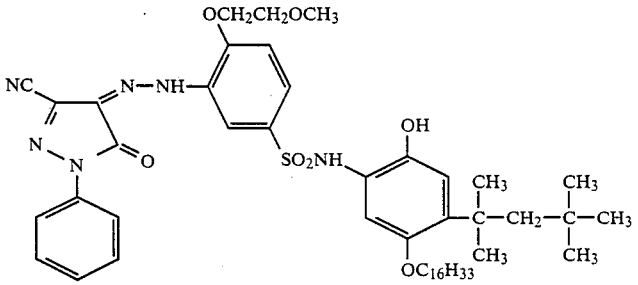
LI-16
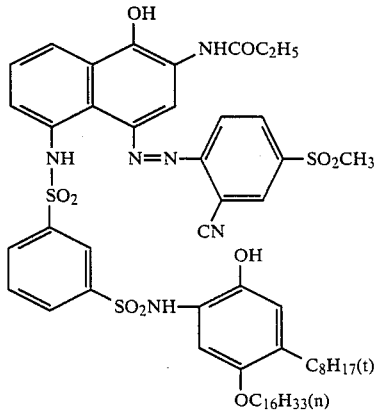

-continued

LI-17

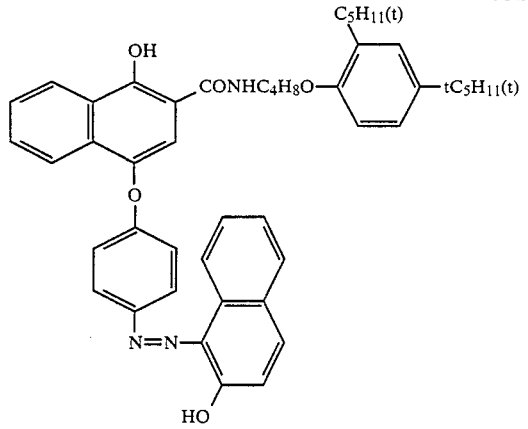

The above-illustrated compounds are only some typical examples out of many, so the present invention is not to be construed as being limited thereto.

Dye-providing substances as illustrated above can be introduced into the photosensitive material of the present invention using known methods as described, for example, in U.S. Pat. No. 2,322,027. Therein, high boiling point organic solvents and low boiling point organic solvents as set forth below can be employed.

For example, after dissolving a dye-providing substance in a high boiling point organic solvent, such as phthalic acid alkyl esters (e.g., dibutyl phthalate, dioctyl phthalate, etc.), phosphoric acid esters (e.g., diphenyl phosphate, triphenyl phosphate, tricresyl phosphate, dioctyl butyl phosphate, etc.), citric acid esters (e.g., tributyl acetylcitrate), benzoic acid esters (e.g., octyl benzoate), alkylamides (e.g., diethyllaurylamide), fatty acid esters (e.g., dibutoxyethyl succinate, dioctylazelate, etc.), trimesic acid esters (e.g., tributyl trimesate) or so on, or in an organic solvent having a boiling point of about from 30° C. to 160° C., such as lower alkyl acetates like ethyl acetate and butyl acetate, ethyl propionate, secondary butyl alcohol, methyl isobutyl ketone, β-ethoxyethyl acetate, methyl cellosolve acetate, cyclohexanone, or so on, the resulting solution is dispersed in a hydrophilic colloid. Upon dissolution of the dye-providing substancesl, the above-described high boiling point organic solvents and low boiling point organic solvents may be used as a mixture of two or more thereof.

In addition, the dispersion technique using the polymers described in Japanese patent publication No. 39853/76 and Japanese patent application (OPI) No. 59943/76 can be employed. Moreover, various kinds of surface active agents can be employed at the time of dispersing the dye-providing substances into hydrophilic colloids. Suitable examples of surface active agents usable for this purpose include those set forth as surface active agents hereinafter.

Image-formation acceleraators can be employed in the present invention. The image-formation accelerators have the functions, for instance, of accelerating the redox reaction of silver salt oxidizers with reducing agents, of accelerating certain reactions, e.g., production of dyes, decomposition of dyes or release of diffusible dyes from dye-providing substance, and so on, and of accelerating the transfer of dyes from some layer of a photosensitive material into dye-fixing layer. According to physiochemical functions, the image-formation accelerators can be classified into several groups, e.g., bases or the precursors thereof, nucleophilic compounds, oils, thermal solvents, surface active agents, compounds having interactions with silver or silver ion, and so on. However, these groups of substances have, in general, compound functions, and as is usual with these substances they have some of the above-described accelerating effects in combination.

Details of the image-formation accelerators are described in Japanese patent application No. 213978/84, pp. 67–71.

Various kinds of development stoppers can be employed in the photosensitive material of the present invention for the purpose of always producing images of steady qualities even though the processing temperature and the processing time fluctuate upon heat development.

The term development stopper used herein is intended to include compounds capable of stopping development by rapidly neutralizing the base or quickly lowering a base concentration in the film upon reaction with the base after correct development, and compounds capable of inhibiting development through interaction with silver and silver salts.

Specific examples of such compounds are described in Japanese patent application No. 213978/84, pp. 72–73.

In addition, compounds capable of working for the stabilization of images simultaneously with the activation of development can be employed in the present invention. Specific examples of compounds which can be preferably used for such purposes are described in Japanese patent application No. 213978/84, pp. 73–74.

Image toning agents can be incorporated in the photosensitive material of the present invention, if desired.

Specific examples of such agents which can be effectively used are describedin Japanese patent application No. 213978/84, pp. 74–75.

Binders can be contained alone or as a combination in the photosensitive material of the present invention. Such binders are hydrophilic binders. The representative of hydrophilic binders are transparent or translucent binders. More specifically, natural substances such as proteins, e.g., gelatin, gelatin derivatives, etc., and polysaccharides, e.g., cellulose derivatives, starch, gum arabic, etc., and synthetic polymers such as polyvinyl pyrrolidone, acrylamide polymers and other water-soluble polyvinyl compounds are included in binders of the above-described kind. Other useful synthetic polymers include dispersible vinyl compounds which can increase in particular the dimensional stability of a photographic material when used in the latex form.

A suitable coverage of the binder of the present invention is 20 g/m$^2$ or less, preferably 10 g/m$^2$ or less, more preferably 7 g/m$^2$ or less.

In dispersing a high boiling point organic solvent into a binder together with hydrophobic compounds such as dye-providing substances and so on, it is appropriate to use the solvent in a quantity of 1 ml or less, preferably 0.5 ml or less, and more preferably 0.3 ml or less, per 1 g of binder.

The photosensitive material of the present invention may contain an inorganic or organic hardener in its photographic emulsion layers or other binder layers. For example, chromium salts (e.g., chrome alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, 1,2-bis(vinylsulfonylacetamido)ethane, etc.), active halogen-containing compounds (e.g., 2,4-dichloro-6-hydroxy-s-triazine, etc.), mucohalogen acids (e.g., mucochloric acid, mucophenoxychloric acid, etc.), and so on can be used alone or as a combination thereof.

Supports to be used for the photosensitive material of the present invention, and optionally for the dye-fixing material, are those which can withstand processing temperatures to be employed. Examples of supports which can generally be used include not only glass, paper, metal, and analogues thereof, but also acetylcellulose film, cellulose ester film, polyvinyl acetal film, polystyrene film, polycarbonate film, polyethylene terephthalate film, and their related films or resinous materials. In addition, paper supports laminated with polymers like polyethylene can be used. Moreover, polyesters described in U.S. Pat. Nos. 3,634,089 and 3,725,070 are used to advantage.

In the case where dye-providing substances capable of releasing mobile dyes in imagewise distribution are employed in the present invention, dye transfer assistants can be employed upon transfer of the dyes from the photosensitive layer to the dye-fixing layer.

Specific examples of such dye transfer assistants are described in Japanese patent application No. 213978/84, pp. 78–79.

In the case where a colored dye-providing substance is incorporated into the photosensitive material of the present invention, the use of anti-irradiation and antihalation substances or various dyes is not so important in the photosensitive material. However, filter dyes, light-absorbing substances and the like as described in Japanese patent application No. 213978/84, pp. 79–80, can be incorporated in the photosensitive material in order to sharpness of the images.

The photosensitive material of the present invention can optionally contain various kinds of additives known to be useful for conventional heat developable photosensitive materials, and can have layers other than photosensitive layers, for example, an antistatic layer, a conductive layer, a protective layer, an interlayer, an antihalation layer, a peel-apart layer, and so on, if needed. As for the additives, those described in *Research Disclosure,* RD No. 17029 (June 1978), for example, plasticizers, sharpness improving dyes, antihalation dyes, sensitizing dyes, matting agents, surface active agents, fluorescent brightening agents, discoloration inhibitors and so on, can be employed.

The photographic material of the present invention is constructed by a photosensitive material which can produce or release dyes by heat development, and a dye-fixing material which can fix the resulting dyes, if desired. In particular, both the photosensitive material and the dye-fixing material are indispensable for the system of forming images through the diffusion transfer of dyes. The abovedescribed image-forming system may have the structure in which the photosensitive material and the dye-fixing material are coated on two separate supports, or the structure in which both the materials are provided on the same support.

Photographic materials having the structure in which the photosensitive material and the dye-fixing material are provided on separate supports are classified into two large groups. One group includes those of the peel-apart type, and the other group includes those of the non peel-apart type. In the case where the photographic material has a structure of the peel-apart type, the coated face of the photosensitive material is brought into contact with the coated face of the dye-fixing material after imagewise exposure or heat development, and the conclusion of the formation of transferred images the photosensitive material is peeled quickly from the dye-fixing element. An opaque support or a transparent support is chosen as the support of the dye-fixing material depending upon whether the final image is an image of the reflection type or one of the transmission type. In addition, a white reflective layer may be provided, if desired. In the case of no peel-apart (integral) type of photographic materials, it is necessary to arrange a white reflective layer between the photosensitive layer in the photosensitive material and the dye-fixing layer in the dye-fixing material. The white reflective layer may be provided in either the photosensitive material or the dye-fixing material. Further, the support of the dye-fixing element needs to be transparent.

The structure which does not require the peeling of the photosensitive material from the image-receiving material after the formation of transferred images is one of the representatives of structures in which both the photosensitive material and the dye-fixing one are provided on the same support. In this case, a transparent or opaque support is coated with a photosensitive layer, a dye-fixing layer and a white reflective layer. A preferred order of these layers may be transparent or opaque support/photosensitive layer/white reflective layer/dye-fixing layer, or transparent support/dye-fixing layer/white reflective layer/photosensitive layer.

Another representative of the structures in which the photosensitive material and the dye-fixing material are provided on the same support is the structure which is so designed as to peel apart or all of the photosensitive material from the dye-fixing material, as described in Japanese Patent Application (OPI) No. 67840/81, Canadian Pat. No. 674,082, U.S. Pat. No. 3,730,718, and so on. Therein, a peeling-apart layer is provided in an appropriate position.

The photosensitive material or the dye-fixing one may have a structure in which an electrically conductive exothermic layer is provided as a heating means for heat development or diffusion transfer of dyes.

In order to obtain various kinds of colors within the range of the chromaticity diagram using three primary colors, i.e., yellow, magenta, and cyan, the photosensitive material to be used in the present invention must have at least three silver halide emulsion layers having their own sensitivities in different spectral regions.

Typical examples of the combination of at least three kinds of photosensitive silver halide emulsion layers, which have their sensitivities in spectral regions different from one another, include the combination of a blue-sensitive emulsion layer, a green-sensitive emulsion layer and a red-sensitive emulsion layer, that of a green-sensitive emulsion layer, a red-sensitive emulsion layer and an infrared-sensitive emulsion layer, that of a blue-sensitive emulsion layer, a green-sensitive emulsion layer and an infrared-sensitive emulsion layer, that of a blue-sensitive emulsion layer, a red-sensitive emulsion layer and an infrared-sensitive emulsion layer, and so on. The term "infrared-sensitive emulsion layer" signifies an emulsion layer having sensitivity to light of 700 nm or longer, and particularly 740 nm or longer.

The photosensitive material of the present invention may have a photosensitive layer which is constructed by two or more emulsion layers having the same spectral sensitivity, but differing in photographic speed from one another.

The above-described emulsion layers each and/or a light-insensitive hydrophilic colloid layer adjacent thereto are/is needed to contain one of dye-providing substances which can produce or release a hydrophilic yellow, magenta, or cyan dye. That is to say, each emulsion layer and/or the light-insensitive hydrophilic colloid layer adjacent thereto is needed to contain a dye-providing substance which can produce or release a hydrophilic dye differing in hue from other dyes which come to be present in other layers. Optionally, two or more kinds of substances which can provide dyes having the same hue may be used as a mixture. If a colored dye-providing substance is employed, it is advantageous to incorporate the colored substance into a light-insensitive layer adjacent to the emulsion layer to be associated therewith. In addition to the above-described layers, the photosensitive material of the present invention can optionally have auxiliary layers such as a protective layer, an interlayer, an antistatic layer, an anticurl layer, a peel-apart layer, a matting layer, and so on.

In particular, it is usual for the protective layer to contain an organic or inorganic matting agent for the purpose of preventing adhesion from occurring. Further, the protective layer may contain a mordant, a UV absorbent, and so on. The protective layer and the interlayer each may be constructed by two or more layers.

The interlayer may contain a reducing agent for the prevention of color stains, a UV absorbent, and a white pigment like $TiO_2$. White pigments may be added to not only the interlayer, but also the emulsion layers for the purpose of increasing the photographic speed.

In order to impart color sensitivities as described above to silver halide emulsions, respectively, each silver halide emulsion has only to be spectrally sensitized using some of known sensitizing dyes so that it may acquire a desired spectral sensitivity.

The dye-fixing element to be used in the present invention has at least one layer containing a mordant. When a dye-fixing layer is situated at the surface of the dye-fixing material, a protective layer may further be provided thereon, if desired.

Moreover, a water absorbing layer or a dye transfer assistant-containing layer can be provided for the purpose of sufficient impregnation with dye transfer assistants as occasion calls, or in order to control the supply of dye transfer assistants. These layers may be adjacent to the dye-fixing layer, or they may be provided on the dye-fixing layer through an interlayer.

The dye-fixing layer to be used in the present invention may be constructed by two or more layers in which mordants differing in mordanting power are used, respectively.

In addition to the above-described layers, the dye-fixing material to be used in the present invention can have auxiliary layers, such as a peel-apart layer, a matting layer, an anticurl layer, etc., if desired.

In one or a plurality of the above-described layers, bases (including the precursors thereof) and hydrophilic thermal solvents for accelerating the dye transfer, antidiscoloration agents and UV absorbents for prevention of color stains, latex-form vinyl compounds for enhancement of dimensional stability, fluorescent brightening agents, and so on may be incorporated.

Suitable binders for the above-described layers are hydrophilic binders, and typical examples thereof include transparent or translucent hydrophilic colloids. For example, natural substances such as protein, e.g., gelatin, gelatin derivatives, etc., and polysaccharides, e.g., cellulose derivatives, starch, gum arabic, dextrin, pulluian, etc., and synthetic polymers such as polyvinyl alcohol, polyvinyl pyrrolidone, acrylamide polymers and other watersoluble vinyl compounds can be employed. Of these substances, gelatin and polyvinyl alcohol are particularly effective.

The dye-fixing material may have a reflective layer containing a white pigment like titanium oxide, a neutralizing layer, a neutralization timing layer, and so on. These layers may be provided in the photosensitive material also. Constitutions of the above-described reflective layer, neutralizing layer and neutralization timing layer are described, for example, in U.S. Pat. Nos. 2,983,606, 3,326,819, 3,362,821, and 3,415,644, and Canadian Pat. No. 928,559.

Further, it is advantageous to the dye-fixing material of the present invention to have the form of containing transfer assistants described hereinafter. The transfer assistants may be incorporated in the dye-fixing layer or in another layer provided on their own account.

A transparent or translucent exothermic element can be provided on a support when an electro-thermo-heating technique is adopted as means of development in the present invention, and the element can be made as a resistance-induced type heater using a conventional known technique.

Particularly preferred mordants to be employed in the dye-fixing layer are polymeric ones. The term polymeric mordant used herein is intended to include polymers containing tertiary amino groups, polymers having nitrogen-containing heterocyclic ring moieties, polymers having nitrogen-containing heterocyclic ring moieties, polymers having nitrogen-containing heterocyclic rings in the form of quaternary cation, and so on.

Specific examples of polymeric mordants are described in Japanese Patent Application No. 213978/84, pp. 90–91.

In carrying out imagewise exposure for recording images on heat-developable photosensitive materials, radiation-containing visible rays also can be employed as light source. Suitable light sources which can be used include various kinds of ones which are generally used for color prints, for example, a tungsten lamp, a mercury lamp, a halogen lamp like an iodine lamp, a xenon lamp, a laser beam source, CRT light source, a fluorescent lamp, a light-emitting diode (LED) and so on.

Heating temperatures which enable the development in the heating step of the present invention are within the range of from about 80° C. to about 250° C. The temperature range of from about 110° C. to about 180° C. is employed to advantage. In particular, the lower limit thereof is preferably 140° C., more preferably 150° C. The heating step includes not only the heat-development step but also the transfer step. Allowable heating temperature in the transfer step are within the range of room temperature to a temperature employed in the heat-development step. More preferred heating temperatures in the transfer step are up to a temperature lower than the temperature employed in the heat development step by about 10° C. Suitable examples of heating means which can be used in the heat development step and/or in the transfer step include a mere hot plate, a flatiron, a heating roller, a heating element utilizing carbon, titanium white or so on.

A dye transfer assistant (e.g., water) is given in a layer between a light-sensitive layer of the heat-developable light-sensitive material and a dye-fixing layer of the dye-fixing layer to result in acceleration of dye transfer. Also, the dye transfer assistant can be incorporated previously into the light-sensitive layer or/and the dye-fixing layer and then, both the layers are superposed upon each other.

Heating in the transfer step can be effected by passing the superposed materials through a pair of hot plates, bringing them into contact with a hot plate (e.g., as described in Japanese Patent Application (OPI) No. 62635/75), bringing them into contact with a rotating hot drum or roller (e.g., Japanese Patent Publication No. 10791/68), passing them through hot air (e.g., Japanese Patent Application (OPI) No. 32737/78, passing them through inert liquid maintained as a prescribed temperature, making them go along the heat source using a roller, a belt or other guiding means (e.g., Japanese Patent Publication No. 2546/69), and so on. On the other hand, a means may be adopted such that a layer of an electically conductive material, e.g., graphite, carbon black, metal and so on, is laminated on the dye-fixing material in advance, and the dye-fixing material is directly heated by passing an electric current through this conductive layer.

A suitable pressure to be given to the heat-developable photosensitive material and the dye-fixing material laid in the superposed condition in order to bring them into close contact with each other, though it depends on embodiments of the materials used, ranges from 0.1 to 100 kg/cm$^2$, preferably from 1 to 50 kg/cm$^2$ (as described, for example, in Japanese Patent Application (OPI) No. 180547/84).

As a means of applying pressure to the heat-developable photosensitive material and the dye-fixing material, various processes, for example, the process of passing the superposed materials through a pair of rollers, the process of pressing the superposed materials with a plate having a smooth surface, and so on. The rollers and the plate used for pressure application can be heated to a temperature ranging from room temperature to a temperature to be employed in the heat development step.

In accordance with the embodiment of the present invention, at least one compound selected from cyclic imino compounds or mercapto compounds is incorporated into a photosensitive material and thereby, heat development becomes feasible therein without using any organic silver salt oxidizers even when silver chloride, silver bromide, silver chlorobromide, mixed crystals of silver iodide and silver chloroiodide, mixed crystals of silver iodide and silver iodobromide, and mixed crystals of silver iodide and silver chloroiodobromide, is employed as light-sensitive silver halide, and the resulting material can provide sufficiently high image density and low for density by heat development.

That is, the present invention enables a saving of silver and that, provides images excellent in signal to noise ratio by heat development.

The present invention is illustrated in greater detail by reference to the following examples.

EXAMPLE 1

A silver halide emulsion was prepared in the following manner.

To a thoroughly stirred aqueous solution of gelatin (which contained 20 g of gelatin and 3 g of sodium chloride in 1,000 ml of water, and was kept at 75° C.) were added 600 ml of an aqueous solution containing sodium chloride and potassium bromide and an aqueous solution of silver nitrate (prepared by dissolving 0.59 mole of silver nitrate in 600 ml of water) at the same time over a period of 40 minutes with an equal flow rate. Thus, a monodisperse silver chlorobromide emulsion having a cubic crystal form and a mean grain size of 0.35 μm (bromide content: 80 mol%) was prepared. After the washing and the desalting steps, the emulsion was chemically sensitized by adding 5 mg of sodium thiosulfate and 20 mg of 4-hydroxy-6-methyl-1,3,3a,7-tetrazaindene at 60° C. The yield of the emulsion was 600 g.

Next, a gelatin dispersion of a dye-providing substance was prepared as follows.

5 g of the magenta dye-providing substance (LI-8), 0.5 g of 2-ethylhexyl sodium sulfosuccinate (as a surface active agent) and 10 g of tri-iso-nonylphosphate were weighed out, and admixed with 30 ml of ethyl acetate. The admixture was heated up to about 60° C. and thereby, it was converted into a homogeneous solution. This solution was mixed with 100 g of a 10% lime-processed gelatin solution with stirring, and dispersed thereinto over a period of 10 minutes using a homogenizer rotating at 10,000 rpm. The thus-obtained dispersion was called the dye-providing substance dispersion.

A light-sensitive coating composition was prepared in the following manner.

(a) Light-sensitive silver chlorobromide emulsion: 20 g (b) Dye-providing substance dispersion 25 g (c) 5% Aqueous solution of compound illustrated below: 5 ml

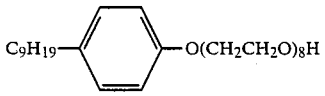

(d) 10% Methanol solution of benzenesulfonamide: 5 ml (e) 10% Aqueous solution of guanidine 4-methylsulfonylphenylsulfonylacetate: 15 ml (f) 0.04% Methanol solution of dye represented by following structural formula: 4 ml

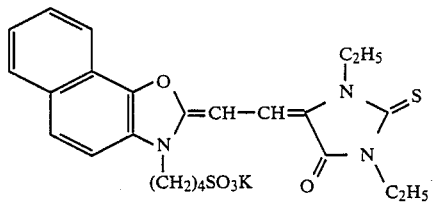

The ingredients set forth above, (a) to (f), were mixed, and a viscosity increasing agent (e.g., sodium polystyrene-p-sulfonate) and water were added thereto to make the total volume 100 ml. The thus-prepared solution was coated on a 180 μm-thick polyethylene terephthalate film at a wet coverage of 50 μm.

Further, a coating composition for a protective layer was prepared.

(h) 10% Gelatin solution: 400 g (i) 10% Aqueous solution of guanidine 4-methylsulfonylphenylsulfonylacetate: 240 ml (j) 4% Aqueous solution of hardener having structural formula $$CH_2{=}CH{-}SO_2CH_2CONH{-}(CH_2)_2{-}NHCOCH{-}{}_2SO_2CH{=}CH_2$$

The above described ingredients (h) to (j) were mixed and thereto, the foregoing viscosity increasing agent and water were added to make the total volume of 1,000 ml.

This coating composition was coated in a 30 μm-thick layer on the above-described light-sensitive composition coated. Thus, the sensitive material 100 was obtained.

The sensitive materials 101 to 109 were further prepared in the same manner as the sensitive material 100 except that silver chlorobromide emulsions adsorbed by the compounds set forth in Table 1 in their respective proportions (mol% shown in Table 1 to 1 mole of silver were employed in place of the silver chlorobromide emulsion of the sensitive material 100.

After drying these sensitive materials, each was exposed imagewise to light of a tungsten lamp through a green filter for one second under illuminance of 2,000 lux. Thereafter, the resulting materials each was uniformly heated for 30 seconds on a hot block maintained at 140° C.

Separately, a dye-fixing material was prepared in the following manner.

10 g of poly(methylacrylate-co-N,N,N-trimethyl-N-vinylbenzylammonium chloride) (methyl acrylate/-vinylbenzylammonium chloride ratio: 1/1) was dissolved in 200 ml of water, and mixed homogeneously with 100 g of a 10% lime-processed gelatin solution. The resulting mixture was coated uniformly in a layer of 90 μm in wet thickness on a paper support laminated with a titanium-dioxide-dispersed polyethylene film. After drying, this sample was used as a dye-fixing material having a mordant layer.

Then, water was supplied to the coated layer side of the dye-fixing material in an amount of 20 ml per square meter and thereafter, the dye-fixing material was brought into a face-to-face contact with the above-described heat-processed light-sensitive material.

After the 6-minute heating on the hot block kept at 80° C., the dye-fixing material was peeled apart from the light-sensitive material. Thereupon, a magenta dye image was obtained on the dye-fixing material.

Density measurements were carried out using a Macbeth reflex type densitometer (RD 519).

The results thus obtained are shown in Table 1.

TABLE 1

| Sensitive Material No. | Compound and Amount Added per Mole of Silver | | Maximum Density | Minimum Density |
|---|---|---|---|---|
| 100 (Comparison) | — | | 0.23 | 0.19 |
| 101 (Invention) | (1) | 3 mol % | 1.83 | 0.23 |
| 102 (Invention) | (8) | 2 mol % | 1.87 | 0.20 |
| 103 (Invention) | (6) | 1 mol % | 1.99 | 0.19 |
| 104 (Invention) | (19) | 2 mol % | 1.53 | 0.25 |
| 105 (Invention) | (24) | 1 mol % | 1.69 | 0.28 |
| 106 (Invention) | (27) | 1 mol % | 1.72 | 0.18 |
| 107 (Invention) | (32) | 1 mol % | 1.92 | 0.22 |
| 108 (Invention) | (33) | 1 mol % | 1.50 | 0.19 |
| 109 (Invention) | (36) | 1 mol % | 1.49 | 0.18 |

As can be seen from the results of Table 1, the sensitive materials 101 to 109 in which the compounds of the present invention were added to their light-sensitive emulsion layers, respectively, were excellent in heat developability and attained sufficiently high maximum density.

EXAMPLE 2

On a polyethylene terephthalate film support, were coated the first layer (lowest layer) to the sixth layer (topmost layer) described below to prepare the multilayer multicolor light-sensitive material 200.

The sixth layer: Layer containing 1,000 mg/m$^2$ of gelatin, 600 mg/m$^2$ of a base precursor*3, 100 mg/m$^2$ of silica*5, and 100 mg/m$^2$ of a hardener*6.

The fifth layer: Green-sensitive emulsion layer containing a silver chlorobromide emulsion (containing 50 mol% of bromide and 500 mg/m$^2$ of silver), 180 mg/m$^2$ of benzenesulfonamide, $10^{-6}$ mol/m$^2$ of Sensitizing Dye D-1, 500 mg/m$^2$ of a base precursor*3, 400 mg/m$^2$ of Yellow Dye-Providing Substance (LI-4), 1,000 mg/m$^2$ of gelatin, 800 mg/m$^2$ of high boiling point solvent*4, and 100 mg/m$^2$ of a surface active agent*2.

The fourth layer: Interlayer containing 1,200 mg/m$^2$ of gelatin and 600 mg/m$^2$ of a base precursor*3.

The third layer: Red-sensitive emulsion layer containing a silver chlorobromide emulsion (containing 80 mol% of bromide and 400 mg/m$^2$ of silver), 180 mg/m$^2$ of benzenesulfonamide, $8\times10^{-7}$ mol/m$^2$ of Sensitizing Dye D-2, 450 mg/m$^2$ of a base precursor*3, 400 mg/m$^2$ of Magenta Dye-Providing Substance (LI-8), 1,000 mg/m$^2$ of gelatin, 600 mg/m$^2$ of a high boiling point solvent*1, and 100 mg/m$^2$ of a surface active agent*2.

The second layer: Interlayer containing 1,000 mg/m$^2$ of gelatin and 600 mg/m$^2$ of a base precursor*3.

The first layer: Infrared-sensitive emulsion layer containing a silver chlorobromide emulsion (containing 50 mol% of bromide and 400 mg/m$^2$ of silver), 180 mg/m$^2$ of benzenesulfonamide, $10^{-8}$ mol/m$^2$ of Sensitizing Dye D-3, 500 mg/m$^2$ of a base precursor*3, 300 mg/m$^2$ of Cyan Dye-Providing Substance (LI-16), 1,000 mg/m² of gelatin, 600 mg/m² of a high boiling point solvent*4, and 100 mg/m² of a surface active agent*2.

Ingredients employed therein are illustrated below.

*1 Tricresyl phosphate

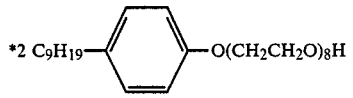

*3 Guanidine 4-methylsulfonyl-phenylsulfonylacetate

*4 (iso-$C_9H_{19}O)_3P{=}O$

*5 Silica having a size of 4 μm

*6 1,1-Bis(vinylsulfonylacetoamido)ethane

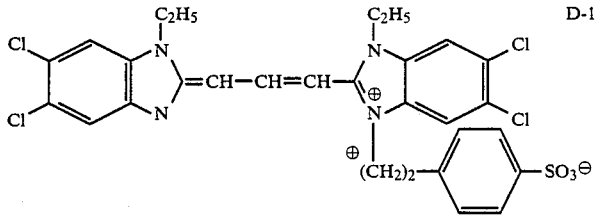

D-1

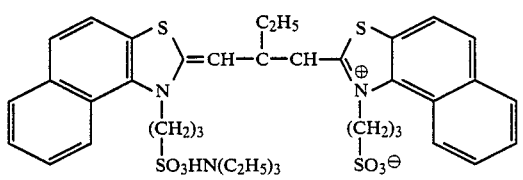

D-2

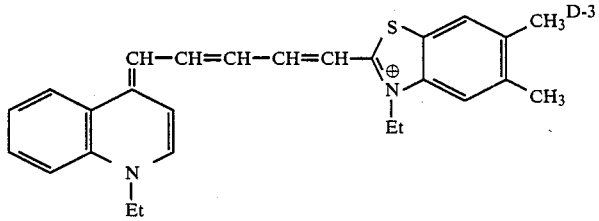

D-3

The silver halide emulsion used in the fifth layer and the first layer was prepared in the following manner.

To a thoroughly stirred aqueous solution of gelatin (which contained 20 g of gelatin and 3 g of sodium chloride in 1,000 ml of water, and was kept at 75° C.) were added 600 ml of an aqueous solution containing sodium chloride and potassium bromide and an aqueous solution of silver nitrate (prepared by dissolving 0.59 mole of silver nitrate in 600 ml of water) at the same time over a period of 40 minutes with an equal flow rate. Thus, a monodisperse silver chlorobromide emulsion having a cubic crystal form and a mean grain size of 0.40 μm (bromide content: 50 mol%) was prepared. After the washing and the desalting steps, the emulsion was chemically sensitized at 60° C. by adding 5 mg of sodium thiosulfate and 20 mg of 4-hydroxy-6-methyl-1,3,3a,7-tetrazaindene. The yield of the emulsion was 600 g.

The silver halide emulsion used in the third layer was prepared in the same manner as in Example 1.

Next, the gelatin dispersion of the dye-providing substance was prepared as follows.

5 g of Yellow Dye-Providing Substance (LI-4), 0.5 g of 2-ethylhexyl sodium sulfosuccinate (as a surface active agent) and 10 g of tri-iso-nonylphosphate were weighed out, and admixed with 30 ml of ethyl acetate. The admixture was heated up to about 60° C. and thereby, it was converted into a homogeneous solution. This solution was mixed with 100 g of a 10% lime-processed gelatin solution with stirring, and dispersed therein into over a period of 10 minutes using a homogenizer rotating at 10,000 rpm. The thus-obtained dispersion was called the yellow dye-providing substance dispersion.

The dispersion of the magenta dye-providing substance was prepared in the same manner as described above except that Magenta Dye-Providing Substance (LI-8) was employed in place of the yellow dye-providing substance and 7.5 g of tricresyl phosphate was used as high boiling point solvent in plce of 10 g of tri-iso-nonylphenyl phosphate.

The dispersion of the cyan dye-providing substance was prepared using Cyan Dye-Providing Substance (LI-16) in a similar manner to the yellow dye-providing substance dispersion.

Sensitive matrial 210 was produced in the same manner as Sensitive Material 200 except that silver chlorobromide emulsions previously adsorbed by 1 mol%, based on silver, of Compound (6) were employed in the same amounts as in their corresponding layers, respectively.

Next, a dye-fixing material having an image-receiving layer was prepared in the following manner.

0.75 g of Gelatin Hardener H-1, 0.25 g of Gelatin Hardener H-2, 160 ml of water and 100 g of a 10% lime-processed gelatin solution were mixed homogeneously. This mixture was coated uniformly on a paper support laminated with a titanium dioxide-dispersed polyethylene film to form a layer having a thickness of 60 μm in a wet condition, and dried. The gelatin hardeners used therein have the following structural formulae, respectively.

Gelatin Hardener H-1

$CH_2{=}CHSO_2CH_2CONH(CH_2)_2NHCOCH_2SO_2CH{=}CH_2$

Gelatin Hardener H-2
$CH_2{=}CHSO_2CH_2CONH(CH_2)_3NHCOCH_2SO_2CH{=}CH_2$

Further, 15 g of a polymer having the structure illustrated below was dissolved in 200 ml of water, and mixed homogeneously with 100 g of a 10% lime-processed gelatin solution. This mixture was coated uniformly on the above-described, coated composition to form a layer having a thickness of 85 μm in a wet composition. Thus, the intended dye-fixing material was obtained.

Polymer used

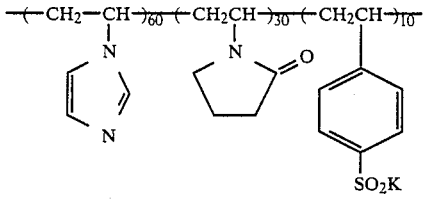

Each of the multilayer multicolor photosensitive materials 200 and 201 was exposed to light from a tungsten lamp for 1 second under illuminance of 500 lux through a separation filter changing continuously in density (constructed by a band pass filter G for green light of from 500 to 600 nm, a band pass filter R for red light of from 600 to 700 nm, and a filter IR for transmitting infrared light longer than 700 nm).

Thereafter, the materials were heated uniformly for 30 seconds on a hot block kept at 140° C.

Then, water was supplied to the coated side of the dye-fixing material in an amount of 20 ml per square meter, and the resulting dye-fixing material was brought into a face-to-face contact with each of the above-described, heat-processed photosensitive materials. The superposed materials were heated for 6 seconds on a hot block kept at 80° C., and, thereafter, the dye-fixing material was peeled apart from the photosensitive material. Thus, yellow, magenta, and cyan dye images were produced on the dye-fixing material corresponding to G, R, and IR (Green, red, and infrared) of the separation filter, respectively.

Both maximum and minimum densities of each color were measured using a Macbeth reflex type densitometer (RD 519).

The results obtained are shown in Table 2.

TABLE 2

| Separation Filter | Dye Image | Sensitive Material 200 (Comparison) Maximum Density | Sensitive Material 200 (Comparison) Minimum Density | Sensitive Material 201 (Invention) Maximum Density | Sensitive Material 201 (Invention) Minimum Density |
|---|---|---|---|---|---|
| IR | Cyan | 0.14 | 0.12 | 1.53 | 0.19 |
| R | Magenta | 0.19 | 0.13 | 1.62 | 0.21 |
| G | Yellow | 0.20 | 0.17 | 1.70 | 0.24 |

As can be seen from the results shown in Table 2, as heat development did not proceed in the photosensitive material not containing Compound (6) of the present invention, images were hardly produced, while the photosensitive material 201 in which the emulsions adsorbed by Compound (6) of the present invention were employed was excellent in heat developability, and provided color images of satisfactorily high qualities.

EXAMPLE 3

A light-sensitive coating composition was prepared as follows.

(a) Light-sensitive silver chlorobromide emulsion (containing 80 mol% of bromide) made in the same manner as in Example 1: 5 g (b) 10% Aqueous solution of gelatin: 2 g (c) Gelatin dispersion of Dye-Providing Substance (LI-17) prepared in the same manner as in Example 1 except that Dye-Providing Substance (LI-17) was used in place of Dye-Providing Substance (LI-8): 12.5 g (d) 10% Ethanol solution of guanidine trichloroacetate: 0.4 ml (e) 10% Methanol solution of 2,4-dichloroaminophenol: 0.5 ml (f) 5% Aqueous solution of compound illustrated below: 10 ml

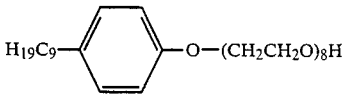

(g) Water: 4.5 ml

The above-described ingredients (a) to (g) were mixed and thereto, 2 ml of a viscosity increasing agent (potassium polystyrene-o-sulfonate) was added. The resulting mixture was coated on a 180 μm-thick polyethylene terephthalate film to form a layer having a thickness of 85 μm in a wet condition.

On the above-described light-sensitive coating composition, gelatin was coated at a coverage of 1.5 g/m$^2$ to form a protective layer.

The thus-prepared sample was designated as Sensitive Material 300.

Sensitive Material 301 was prepared in the same manner as Sensitive material 300 except that the silver chlorobromide emulsion which had been adsorbed by Compound (34) in a proportion of 1 mol% to silver was employed. Also, Sensitive Material 302 was prepared in the same manner as Sensitive Material 301 except that 2 mol%, based on silver, of Compound (5) was used for the adsorption on the surfaces of the silver chlorobromide grains in place of 1 mol%, based on silver, of Compound (34).

Then, a dye-fixing material was prepared by coating cellulose diacetate on baryta paper at a coverage of 2 g/m$^2$, and drying it.

After drying the foregoing Sensitive Materials 300 to 302, each was exposed to white light from a tungsten lamp for 1 second under illuminance of 500 lux.

The resulting materials each was brought into a face-to-face contact with the above-described dye-fixing material, and the superposed materials was heated at 160° C. for 45 seconds using a flatiron. then, the dye-fixing material was peel apart from the sensitive material. Thereupon, yellow dye image was obtained in the fixing material.

Density measurements of the thus-obtained images were carried out using a Macbeth reflex type densitometer through a blue filter.

The results obtained are shown in Table 3.

TABLE 3

| Sensitive Material | Compound | Maximum Density | Minimum Density |
|---|---|---|---|
| 300 (Comparison) | — | 0.26 | 0.23 |
| 301 (Invention) | (34) | 1.05 | 0.29 |
| 302 (Invention) | (5) | 0.92 | 0.27 |

As can be seen from the results shown in Table 3, Sensitive Materials 301 and 302, to which the compounds of the present invention were added in advance, were excellent in heat developability, and achieved sufficiently high maximum density.

While the invention has been described in detail and with reference to specific embodiments thereof, it will be apparent to one skilled in the art that various changes and modifications can be made therein without departing from the spirit and scope thereof.

What is claimed is:

1. A heat-developable photosensitive material having, on a support, a layer comprising a binder, a light-sensitive silver halide selected from the group consisting of silver chloride, silver bromide, silver chlorobromide, mixed crystals of silver iodide and silver chloroiodide, mixed crystals of silver iodide and silver iodobromide, and mixed crystals of silver iodide and silver chloroiodobromide, a reducing agent, and at least one compound selected from cyclic imino compounds and mercapto compounds, wherein said cyclic imino compounds are selected from those represented by the formulae (III) through (XI)

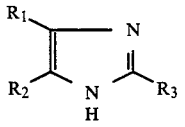
(III)

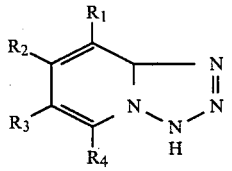
(IV)

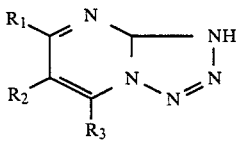
(V)

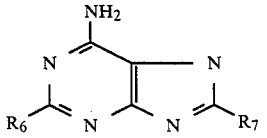
(VI)

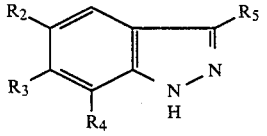
(VII)

-continued

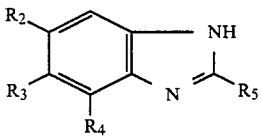
(VIII)

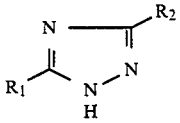
(IX)

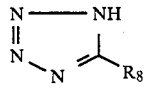
(X)

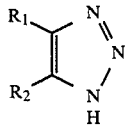
(XI)

wherein $R_1$, $R_2$, $R_3$, and $R_4$ each represents a hydrogen atom, an alkyl group, an aralkyl group, an alkenyl group, an alkoxy group, an aryl group, —NRR′, —COOR″, —CONRR′, —$NHSO_2R$, —$SO_2NRR'$, —$NO_2$, a halogen atom, —CN, or —OH (wherein R and R′ each represents a hydrogen atom, an alkyl group, an aryl group, or an aralkyl group, and R′ represents an alkyl group, an aryl group, or an aralkyl group), or $R_1$ and $R_2$ together form an aliphatic group carbocyclic ring, or in the case of formula (XI) form an aromatic carbocyclic ring, $R_5$ represents a hydrogen atom, an alkyl group containing from 1 to 5 carbon atoms, or —S—R‴ (wherein R‴ represents a hydrogen atom, an alkyl group, an aryl group or an aralkyl group), $R_6$ represents a hydrogen atom or an alkyl group, $R_7$ represents a hydrogen atom, an alkyl group, or an aryl group, and $R_8$ represents an alkyl group, an aryl group, a benzyl group, or a pyridyl group; and the mercapto compounds are represented by formula (XII)

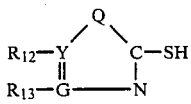
(XII)

wherein

Q represents an oxygen atom, a sulfur atom, or —NR⁗ (wherein R⁗ represents a hydrogen atom, an alkyl group, an unsaturated alkyl group, a substituted or unsubstituted aryl group, or a substituted or unsubstituted aralkyl group), Y and G each represents a carbon atom or a nitrogen atom, and $R_{12}$ and $R_{13}$ each represents a hydrogen atom, an alkyl group, an unsaturated alkyl group, a substituted or unsubstituted aryl group, a substituted or unsubstituted aralkyl group, —SR⁗′ or —$NH_2$ (wherein R⁗′ represents a hydrogen atom, an alkyl group, an aryl group, an aralkyl group, an alkylcarboxylic acid, or alkali-metal alkylcarboxylate group, or an alkylsulfonic acid or alkali-metal alkylsulfonate group), or $R_{12}$ and $R_{13}$ together form a substituted or unsubstituted aromatic carbocyclic ring, or a substituted or unsubstituted nitrogen-containing heterocyclic ring, except that when Q represents —NR'''', $R_{12}$ and $R_{13}$ do not simultaneously represent a hydrogen atom, wherein the total content of the cyclic imino compounds and mercapto compounds is from 0.05 to 10 mol% per mole of silver in the light-sensitive silver halide.

2. A heat-developable photosensitive material as in claim 1, wherein said compounds represented by formulae (III) through (XII) contain no carboxylic acid group nor sulfonic acid group substituents.

* * * * *